US008534697B2

(12) United States Patent
Lengel

(10) Patent No.: US 8,534,697 B2
(45) Date of Patent: Sep. 17, 2013

(54) TELEMARK TECH SYSTEM SKI BINDING

(76) Inventor: Mark C. Lengel, Salt Lake City, UT (US)

( * ) Notice: Subject to any disclaimer, the term of this patent is extended or adjusted under 35 U.S.C. 154(b) by 54 days.

(21) Appl. No.: 13/187,512

(22) Filed: Jul. 21, 2011

(65) Prior Publication Data

US 2012/0018981 A1 Jan. 26, 2012

Related U.S. Application Data

(60) Provisional application No. 61/366,820, filed on Jul. 22, 2010.

(51) Int. Cl.
*A63C 9/00* (2012.01)

(52) U.S. Cl.
USPC ..... 280/617; 280/619; 280/623

(58) Field of Classification Search
USPC ..... 280/611, 615, 617, 619, 623, 618, 280/620, 601, 616
See application file for complete search history.

(56) References Cited

U.S. PATENT DOCUMENTS

| | | | | |
|---|---|---|---|---|
| 4,348,036 | A * | 9/1982 | Settembre | 280/615 |
| 6,371,506 | B1 * | 4/2002 | DeNicola | 280/607 |
| 6,467,796 | B1 * | 10/2002 | Weltman et al. | 280/615 |
| 7,357,406 | B2 * | 4/2008 | Krumbeck et al. | 280/611 |
| 7,735,851 | B2 * | 6/2010 | Shute et al. | 280/614 |
| 2003/0189315 | A1 * | 10/2003 | Venable et al. | 280/616 |
| 2008/0116663 | A1 * | 5/2008 | Gyr | 280/611 |
| 2011/0025003 | A1 * | 2/2011 | Moore et al. | 280/11.33 |

* cited by examiner

*Primary Examiner* — John Walters
*Assistant Examiner* — Brian Swenson
(74) *Attorney, Agent, or Firm* — J. Todd Rushton

(57) ABSTRACT

The present invention relates to a telemark ski binding system that includes a first coupling configured to couple a ski to the toe of a ski boot and a second coupling configured to attach the ski to the heel of the ski boot. The second coupling may attach to the ski separately from the first coupling. The first coupling attaches to the boot using a freely rotating, releasable toe coupling design. The second coupling incorporates a flexible attachment that facilitates vertical movement of heel of the ski boot with respect to the ski and connects to the ski underneath or near the bellows of the boot.

10 Claims, 5 Drawing Sheets

TELEMARK TECH SYSTEM SKI BINDING

This application claims priority to provisional application US61/366,820, Filed Jul. 22, 2010. The disclosure therein incorporated by reference.

BACKGROUND

The field of invention generally relates to ski boot to ski binding interface, and more particularly, to a ski boot to binding interface, where the toe piece is a releasable tech style binding and the heel retention is accomplished using a rear mounted flexible cable style binding.

The general activity of skiing comprises many subsets of activities, including, but not limited to alpine touring, telemark, cross-country, and downhill. Each subset generally corresponds to a unique system of specialized equipment. For example, the boot and binding systems used for telemark skiing differ significantly from those used for downhill skiing. A skiing system may include standard types of bindings, boots and skis. Each type of skiing corresponds to unique characteristics of a binding to achieve optimal performance for that type of skiing. In addition, particular terrain, distance traveled and skier preference may require an even more specific set of performance characteristics. Boots and bindings must be compatible with each other in order to interface effectively.

Telemark skiing requires that a user be able to articulate their foot, bending the metatarsal phalangeal joint and allowing the user's heel to rotate away or rise in respect to the top surface of the ski. Most conventional telemark boot binding interface systems utilize an extended sole at the front of the boot called a "duckbill" and metal clamp or bail to couple the boot to the ski. The rotational freedom of the user's heel is limited by the flexibility of the boot and binding coupling. This system requires that the duckbill and toe region of the boot be sufficiently rigid to prevent undesired torsion of the duckbill and to allow the user to control the trailing ski while executing a telemark turn. The required rigidity necessitates relatively heavy material for both the duckbill and toe portion of the boot. This duckbill boot binding interface creates a toe biased pivot that is difficult to eliminate without over compensating by significantly increasing the rigidity and weight of both the boot and binding.

It is highly desirable while ascending steep terrain to freely rotate the user's foot vertically with a full range of motion. A freely rotating pivot connection near the user's toe allows the skier to make an efficient, resistance free, stride. A rigid duckbill style boot and conventional telemark bindings resist upward rotating movement of the foot while ascending, significantly increasing the effort required to ascend. Some current telemark bindings accomplish a free range of motion by adding a pivot or hinged plate to the front of the telemark binding. However, this arrangement can increase the binding weight and creates an unpleasant noise when the hinge and associated plate contacts the ski top sheet. Additionally, this arrangement also often has a limited range of motion due to the metal clamp impeding forward travel of the binding.

Traditional telemark bindings create a fixed attachment between the boot duckbill and a rigid binding bail. This arrangement does not allow the skier to be separated from the ski unless the user manually releases the bail. If a skier is caught in an avalanche, a fixed ski can act as an anchor, preventing them from rising to the surface of the snow and increasing their chance of a fatal burial. Additionally, an attached ski can generate significant torsional stress on a skier's lower leg in the event of a violent crash, possibly causing fractures and knee injuries.

Tech style bindings, such as the Dynafit® TLT, have been in production since the early 1990's and have provided an alternative to traditional telemark bindings for backcountry skiing. The tech style front binding toe piece uses two spring loaded pins that fit into corresponding holes or sockets in the sides of the ski boot toe. The pins allow the boot to freely rotate from a planted or relaxed position on the ski, to a position where the sole of the boot is flexed or past perpendicular to the ski. This full rotational movement allows the skier to freely slide the ski when gliding or to lift the ski when ascending a slope. The tech style front binding also provides the increased safety of a "rough" (non-calibrated and non-adjustable release) release in the event of a crash, potentially protecting the user's leg and knee. Some tech style toe connections compatible with the telemark tech system offer a calibrated, adjustable release. Tech style toe piece bindings are designed to be used in correlation with a rear binding where a user's heel is locked in a fixed position attached to the ski when descending. This fixed position forces the user to descend using parallel turns, typically associated with downhill skiing, or alpine touring. A signature trait of the telemark turn is the user flexes both knees with the majority of their weight on the downhill ski; the uphill ski drops behind in an offset position, forcing the user's heel to rise away from the trailing ski. A proper telemark ski turn cannot be executed when using skis equipped with a fixed heel, such as, tech style bindings, as commonly known in the art.

Therefore, there is a need in the industry for a boot binding interface system that has a fully rotating front binding, minimizes weight, optimizes telemark skiing performance and is releasable.

SUMMARY OF THE INVENTION

The present invention relates to a light weight telemark ski boot binding system configured with a tech style, fully rotatable, releasable front binding, coupled to a ski at a point corresponding to the toe of the boot, allowing free rotation of the foot for ascending, with the added safety of ski release during a fall. The tech style front binding is combined with a flexible coupling, cable type, rear binding attached to the top of the ski, under the ball of the foot or the phalangeal metatarsal joints of the user. The cable binding clamps to the heel portion of the user's boot and is designed to be engaged prior to descending a slope.

In a first embodiment of the present invention, the tech style front binding includes two spring loaded cantilevered upright members, each upright member having a lateral pin designed to engage a corresponding socket in the toe portion of the ski boot. When engaged, the user is able to freely rotate the boot from a relaxed position substantially parallel to the ski to a flexed position substantially perpendicular to the ski. This movement allows the user to glide the ski on the snow when striding or ascending a slope. The spring loaded upright members are configured to move away under a torsional load, or sideways acting force, allowing the lateral pins to disengage from the corresponding sockets and safely separating the user from the ski.

The rear binding is a flexible cable type with the attachment point of the cable moved rearward from the traditional position near the front binding bail or the user's boot toe. The rear binding includes a mounting block or blocks, cables or rods, tension springs and a heel lever. The mounting block positions the pivot point of the rear binding under ball of the user's foot or, more specifically, under the phalangeal metatarsal joints. This location also corresponds with the flexible toe portion, or bellows, of the user's ski boot. The rear binding is released and may simply rest on the top of the ski, or may be completely removed, while striding or ascending. When engaged, the cables or rods and springs are parallel with the length of the ski boot and the lever is positioned near the middle of the boot heel and pulled into an upright locked position, tensioning the springs. This engagement creates a stiffening effect that provides the user with some additional control for the trailing ski during a telemark turn. With the pivot point of the cable binding moved reward, a greater portion of the user's boot remains in contact with the ski, this precludes the user from dropping into a "deep" telemark turn and forces the user to execute the telemark turn in a better "high T" form. The increased contact area of the boot on the trailing ski provides substantially improved control and stability over a flexible binding in a traditional arrangement. The location of the cable mounting block or blocks can be moved forward or back to change the contact point with the boot, changing the activeness of the ski. Additionally, the height of the cable mounting blocks can be changed to compensate for a different tech style front binding or to change the ramp angle for the binding assembly or the angle of the boot bottom from toe to the flexible bellows point.

In one embodiment of the present invention, the front tech style binding is equipped for a rough release.

In another embodiment of the present invention, the front tech style binding is equipped with a calibrated release, determined by the weight and skiing performance of the user.

In yet another embodiment of the present invention, the front tech style binding is equipped with a lock-out feature to prevent release.

In one embodiment of the present invention, the rear binding cable or rods, and springs extend from the mounting point, around opposite sides of the outside of the ski boot, and engage the boot heel with a cam-over lever.

In another embodiment of the present invention, the rear binding cable or rods and springs extend toward the heel underneath the sole of the ski boot or in an underfoot position.

In yet another embodiment of the present invention, the rear binding cable and springs is a single stranded tensioning assembly positioned underfoot allowing for weight reduction of the overall assembly.

In one embodiment of the present invention, the rear binding engages the boot at a "second heel" located in the arch of the foot region between the toe and the traditional rear heel. The "second heel" is an additional ledge added to the boot sole to allow the rear cables to attach to the middle of the foot.

In one embodiment of the present invention, the rear binding assembly is removable to reduce weight while ascending.

One embodiment of the present invention includes a heel pad to allow the user to completely engage the ski in a substantially level boot position. In yet another embodiment of the present invention, the heel pad is second height allowing the user to adjust ramp angle of the binding assembly and feel of the ski.

In one embodiment of the present invention, the mounting block or mounting blocks are a first height to correspond with the height of the tech style front binding and heel pad. In another embodiment of the present invention, the mounting block or mounting blocks are a second height to correspond with the height with a different tech style front binding and heel pad. The mounting block height can be used to modify the ramp angle and feel of the binding assembly.

In one embodiment of the present invention, the mounting blocks are in fixed position. In another embodiment of the present invention, the mounting blocks are moveable, allowing the user to facilitate fitting the binding to a different boot size, to readily change rear bind cable tension and to adjust the activeness of the ski. The mounting blocks may also have multiple locations to hold the heel connecting rods, allowing the user to modify the amount of resistance provided by the real heel attachment.

In one embodiment of the present invention, the front tech style binding, the mounting blocks for the cable style rear binding and the heel pad are mounted independently on the top surface of a ski.

In another embodiment of the present invention, the front tech style binding, the mounting blocks for the cable style rear binding and the heel pad are mounted on a plate system, which is attached to the top surface of the ski, allowing for precision mounting tolerances.

In yet another embodiment of the present invention, the mounted plate system allows the user to adjust the binding size and adjust the position of the binding assembly longitudinally to change skier weight distribution and skiing characteristics.

It is contemplated to manufacture the Telemark Tech System Ski Binding of the present invention using conventional materials, such as, steel, aluminum, titanium, plastics or composite material. However, the assembly may be manufactured using any acceptable material or materials currently known or yet to be developed.

These and other features and advantages of the disclosure will be set forth and will become more fully apparent in the detailed description that follows and in the appended claims. The features and advantages may be realized and obtained by the instruments and combinations particularly pointed out in the appended claims. Furthermore, the features and advantages of the disclosure may be learned by the practice of the methods or will be obvious from the description, as set forth hereinafter.

BRIEF DESCRIPTION OF DRAWINGS

The following description of the embodiments can be understood in light of the Figures, which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals in different drawings represent the same element, and thus their descriptions may be omitted.

DETAILED DESCRIPTION OF THE DRAWINGS

Figure 1:
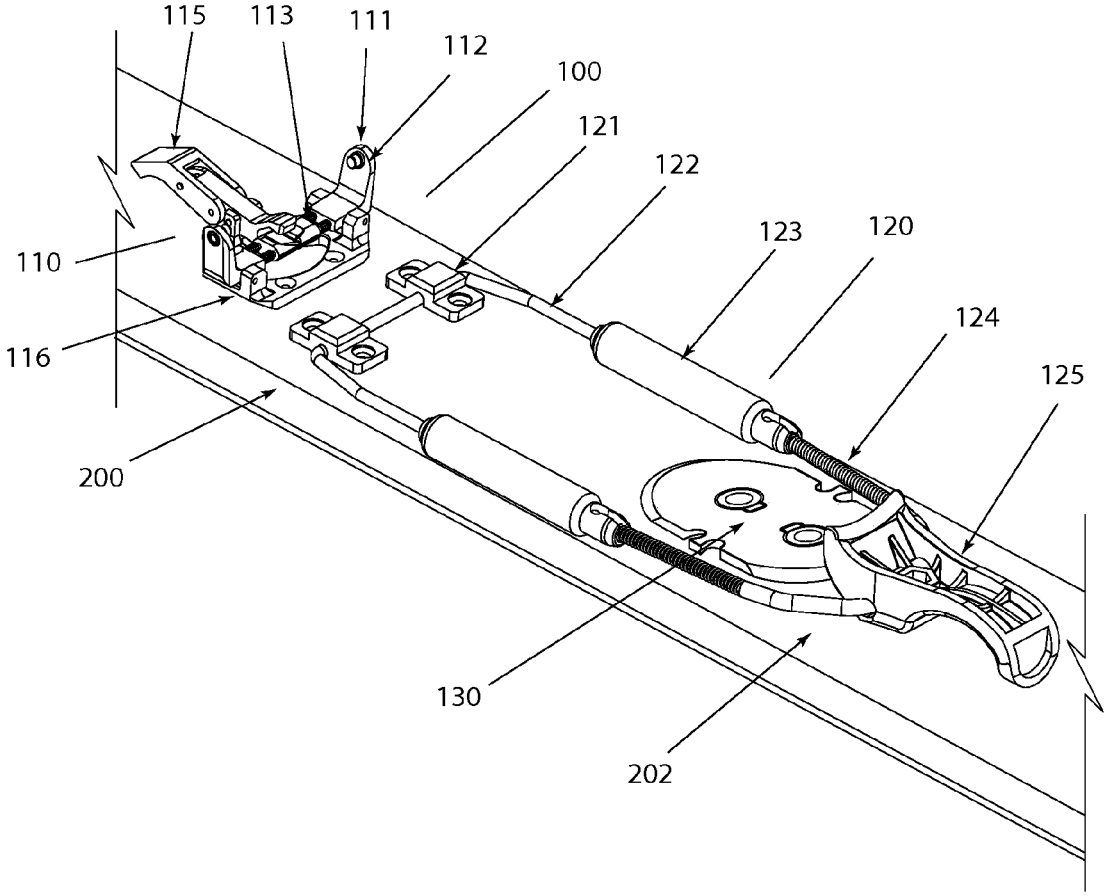
FIG. 1, is a telemark tech system ski binding assembly.

FIG. 1 is one embodiment of the present invention, or more specifically, a telemark tech system ski binding 100, having a tech style front binding assembly 110 and rear binding assembly 120. Tech style front binding 100 including, two cantilevered upright members 111 biased toward a closed or engaged position with springs 113, a lateral pin 112 near the top portion of each of the upright members 111 is configured to engage a reciprocal socket or hole (not shown) in the toe of the user's boot. Upright levers 111 may be positioned horizontally, however they are still spring loaded to engage the boot sockets in the same manner as the vertical levers. The functional components of the tech style front binding 110 are assembled on base 116. The upright members 111, with lateral pins 112 are moved into a closed or engaged position with the user's boot by actuating lever 115. The rear binding assembly 120 includes, cable mounting blocks or block 121, cable or flexible rod 120, internal compression spring adjustment assembly 123, cable and spring assembly 124 and heel lever 125. Both binding assemblies 110 and 120 may be independently attached to the top surface 202 of ski 200 or the binding assemblies 110 and 120 can be prepositioned on a unitized mounting plate (not shown) and mounted on ski 200. The height of cable mounting blocks 121 may vary depending on the model or style of the tech style front binding 110 and the heel pad 130.

Figure 2:
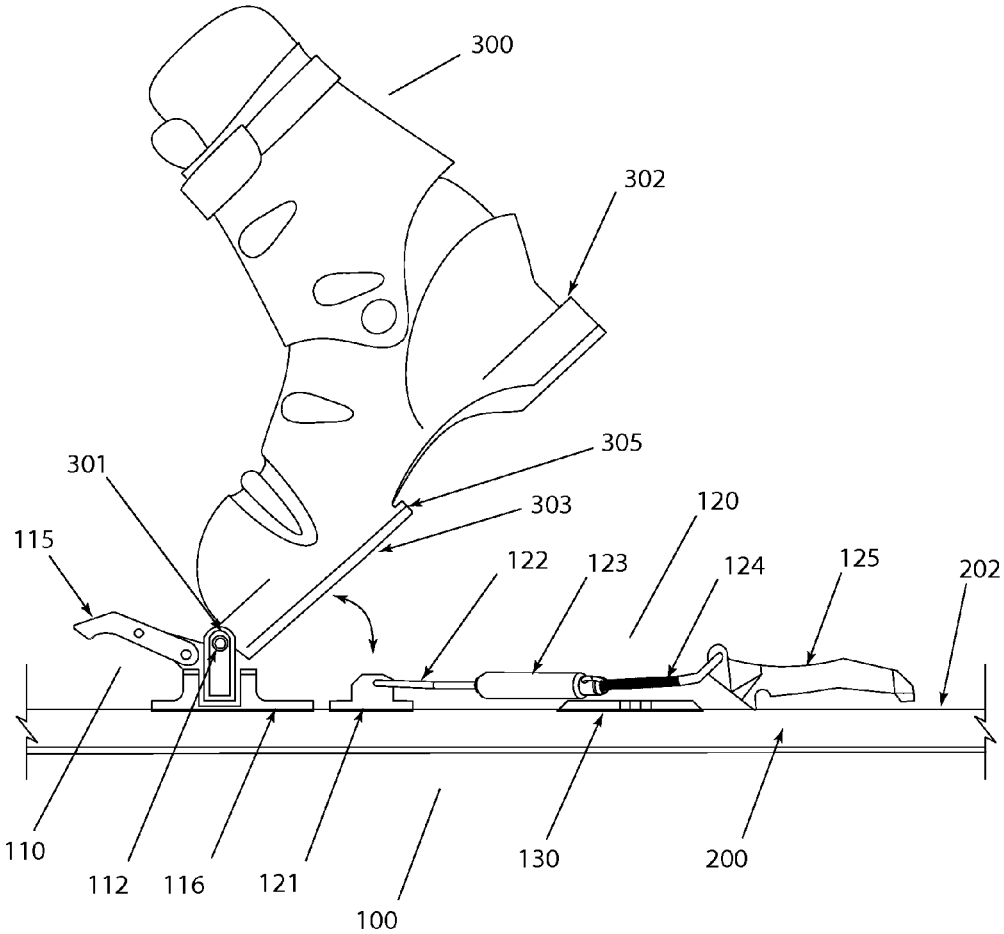
FIG. 2, is a telemark tech system ski binding showing the ski boot in a flexed full rotating position.

FIG. 2 shows one embodiment of the tech system ski binding 100 with ski boot 300 shown in a flexed freely rotating, gliding or climbing position. The toe 301 of ski boot 300 includes sockets or holes (not shown) which correspond with lateral pins 112 of front binding 110, with the lateral pins 112 engaged with the boot sockets, and the rear binding assembly 120 disengaged, the user's boot is fully rotatable from a relaxed down position, where the sole 303 of boot 300 is substantially parallel with the top surface 202 of ski 200, to a fully articulated flexed position, where the sole 303 of boot 300 is perpendicular or slightly past perpendicular with the top surface 202 of ski 200. Free rotational movement allows the user to efficiently glide or lift the ski when ascending a slope. In one embodiment of the present invention, or the tech system ski binding 100, the rear binding assembly 120 is configured to allow connection to a "second heel" 305 located on the sole of the ski boot 300 just forward of the mid-sole.

Figure 3:
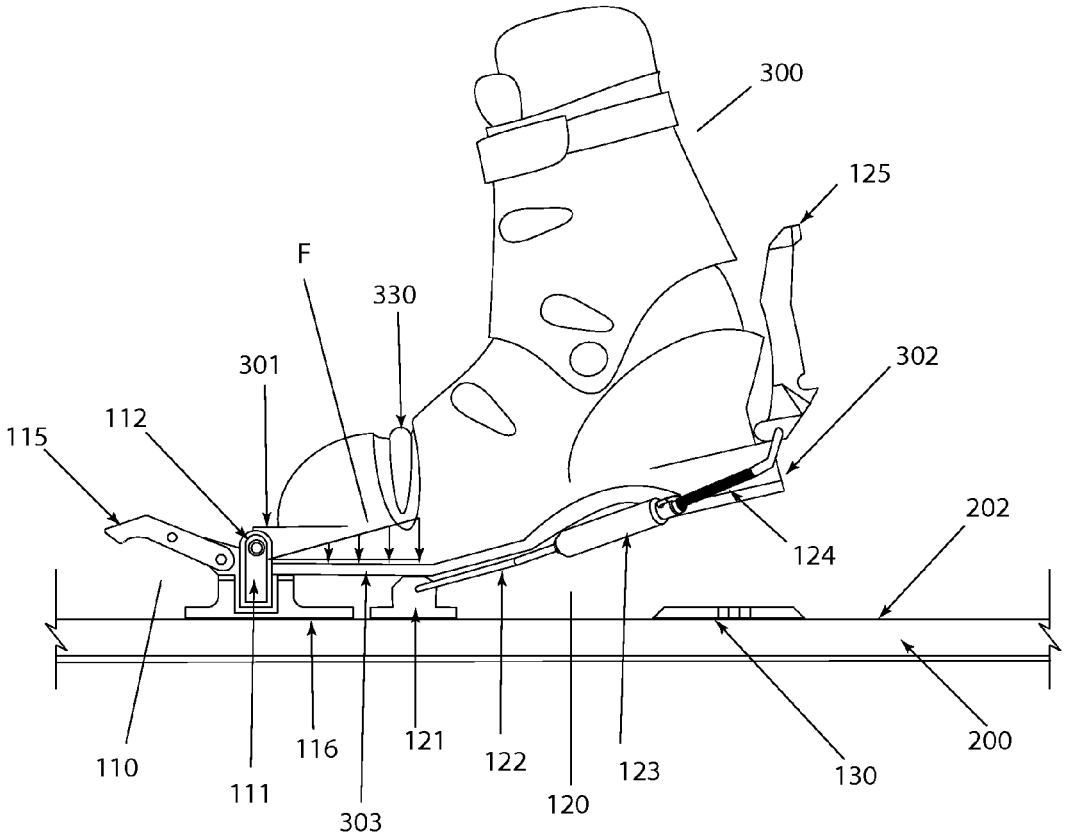
FIG. 3, is a telemark tech system ski binding fully engaged with a ski boot.

FIG. 3 shows one embodiment of the tech system ski binding 100 with the rear binding assembly 120 engaged for a telemark descent. Prior to descent the user will place heel lever 125 over the platform of boot heel 302 and lift the lever 125 into a locked position. This position, tensions internal compression spring assembly 123 providing a stiffening effect to boot 300 and prevents torsional movement of boot 300 in regards to the longitudinal axis of the ski 200. The tension in springs 123 provides the user an improved level of control for the trailing ski during a telemark turn. Additionally, the cable mounting blocks 121 of the rear binding assembly 120 are mounted further back from the toe than a traditional telemark cable binding. When the rear binding 120 is in an engaged position, the mounting blocks 121 force the pivot point of the user's boot 300 to a position directly under the ball of the user's foot or the phalangeal metatarsal joints, which position, also corresponds to the flex point or bellows 330 of boot 300. Placing the pivot point of the boot 300 further back, inherently creates increased contact pressure, illustrated as force zone F, between the boot sole 303, front binding 110 and cable mounting block 121. The increased force F is translated directly to ski 200 providing the user with additional control.

Figure 4A:
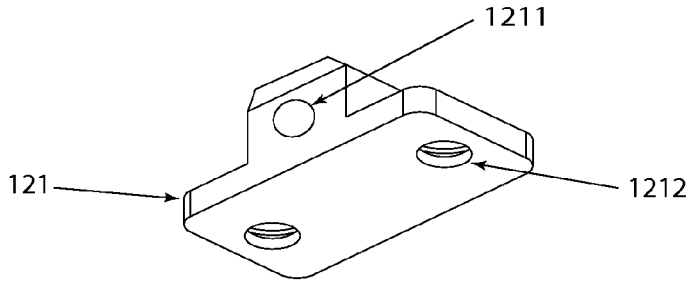
FIG. 4A, is an orthogonal view of a cable mounting block.
Figure 4B:
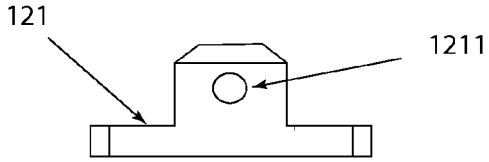
FIG. 4B, is a cable mounting block of a first height.
Figure 4C:
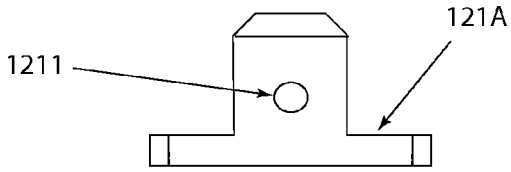
FIG. 4C, is a cable mounting block of a second height.
Figure 4D:
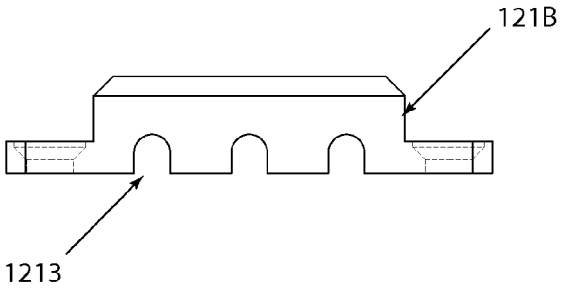
FIG. 4D, is a cable mounting block having multiple cable connection slots.

FIG. 4A is an orthogonal view of the cable mounting block 121, having cable hole 1211 and mounting holes 1212. It is contemplated that cable mounting block 121 may be used in pairs or used as a larger singular block 121. FIG. 4B is a front view of a cable mounting block 121 of a first height, while FIG. 4C is a cable mounting block 121A of a second height. The height of cable mounting block can be changed to correspond with height of different tech style front bindings 110 and heel plate assemblies 130 or to effect ramp angle of the binding assembly 100. FIG. 4D is a cable mounting block 121B with multiple cable slots 1213, allowing the user to adjust the cable 122 loop for user boot 300 size and to change spring 123 tension. Mounting blocks 121 can be mounted forward and aft on the ski 200 and can be mounted at any width to provide the user maximum torsional control of the ski 200 edge. The split mounting block 121 pairs, allow the telemark tech ski binding 100 to accommodate narrow, as well as, modern wide skis 200.

Figure 5:
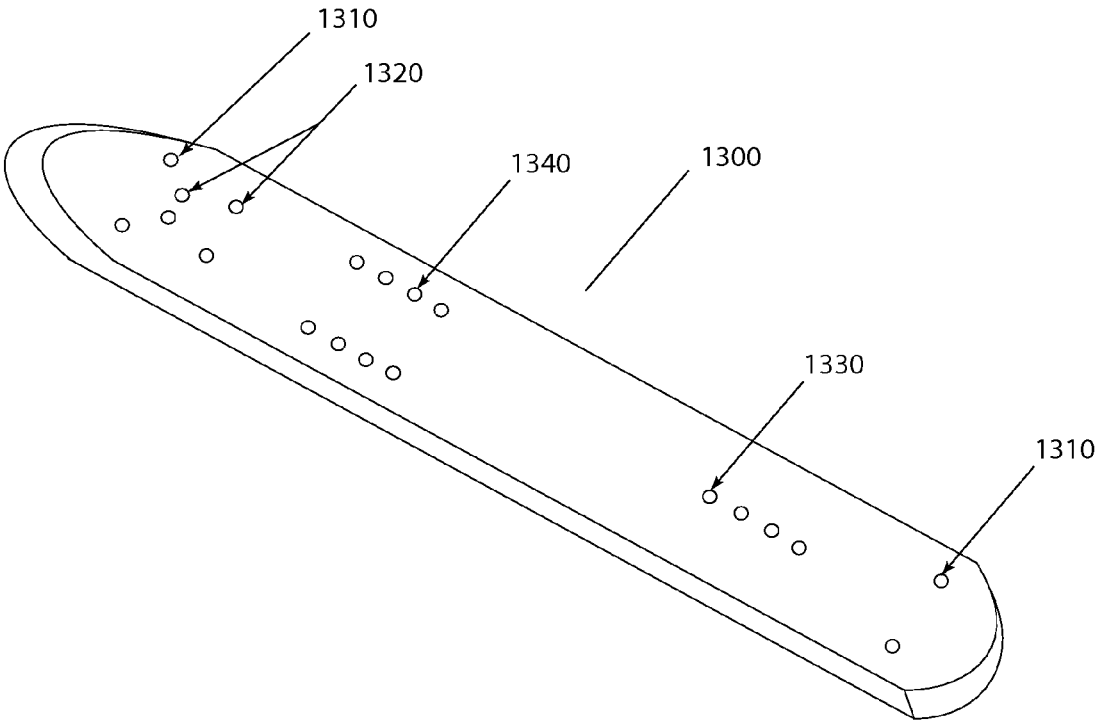
FIG. 5, is one embodiment of a unitized binding mounting plate.

FIG. 5 shows one embodiment of the present invention having a unitized binding mounting plate 1300 allowing the tech system ski binding 100 to be mounted directly to mounting plate 1300 and be moved from one set of skis to another in an assembled and adjusted form. The mounting plate 1300 includes, plate mounting holes 1310, front binding mounting holes 1320, rear heel block or binding mounting holes 1330 and a plurality of mounting block holes 1340 allowing the user to adjust the position of mounting block 121. Holes 1320, 1330 and 1340 may be threaded to receive a screw. Mounting holes configuration are by example only, with hole arrangement in mounting plate 1300 variable by binding type and model.

It is to be understood that the above mentioned arrangements are only illustrative of the application of the principles of the present disclosure. Numerous modifications or alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. A ski binding comprising;
tech style front coupling, having,
opposing lateral engagement pins releasably engaging corresponding sockets in the toe of a ski boot,
a flexible rear coupling, having,
a mounting block,
of a first height,
fixedly attached to the top surface of a ski in a first position under the ball of the user's foot,
the mounting block actively engaging the sole of the user's ski boot when a retention loop attached to the mounting block, including,
at least one tension spring, and,
a heel lock lever is releasably coupled to the user's boot.

2. The ski binding of claim 1, wherein the front coupling includes a calibrated release.

3. The ski binding of claim 1, wherein the front coupling including a release lock.

4. The ski binding of claim 1, wherein the mounting block of a first height is exchanged for a mounting block of a second height.

5. The ski binding of claim 1, wherein the mounting block is moveable both longitudinally and laterally to at least a second position.

6. The ski binding of claim 1, wherein the rear coupling is removable.

7. The ski binding of claim 1, wherein the heel lock lever engages the heel piece on a ski boot.

8. The ski binding of claim 1, including a unitized binding mounting plate.

9. The ski binding of claim 1 wherein the toe of the ski boot can pivotally rotate around the lateral engagement pins a full range of 0 degrees to 90 degrees.

10. The ski binding of claim 1 wherein the mounting block supports the sole of the user's ski boot.

* * * * *